United States Patent [19]

Wheatley et al.

[11] 4,366,676

[45] Jan. 4, 1983

[54] CRYOGENIC COOLER APPARATUS

[75] Inventors: John C. Wheatley; Douglas N. Paulson, both of Del Mar; Paul C. Allen, Sunnyvale, all of Calif.

[73] Assignee: The Regents of the University of California, Berkeley, Calif.

[21] Appl. No.: 218,428

[22] Filed: Dec. 22, 1980

[51] Int. Cl.[3] ..... F25B 9/00

[52] U.S. Cl. ..... 62/6; 62/514 R

[58] Field of Search ..... 62/6, 514 R

[56] References Cited

U.S. PATENT DOCUMENTS

| | | | |
|---|---|---|---|
| 3,218,815 | 11/1965 | Chellis et al. | 62/6 |
| 3,321,926 | 5/1967 | Chellis | 62/6 |
| 3,372,554 | 3/1968 | Prast et al. | 62/6 |
| 3,376,712 | 4/1968 | London | 62/6 |
| 3,530,681 | 9/1970 | Dehne | 62/6 |
| 3,678,992 | 8/1972 | Daniels | 165/10 |
| 3,717,004 | 2/1973 | O'Neil | 62/6 |
| 3,765,187 | 10/1973 | Horn | 62/6 |
| 3,794,110 | 2/1974 | Severijns | 165/164 |
| 3,991,586 | 11/1976 | Acord | 62/6 |
| 4,019,336 | 4/1977 | Mijnheer et al. | 62/6 |
| 4,044,567 | 8/1977 | Dix et al. | 62/6 |
| 4,078,389 | 3/1978 | Bamberg | 62/6 |
| 4,090,859 | 5/1978 | Hanson | 62/6 |

OTHER PUBLICATIONS

"Principles of Liquids Working in Heat Engines", by P. C. Allen et al., *Proceedings of the National Academy of Sciences USA,* vol. 77, No. 1, pp. 39–43, Jan. 1980.

"The Stirling Refrigeration Cycle", by J. W. L. Köhler, published in Scientific American.

"Timed Surge Chamber Creates Self-Acting Cryogenic Cooler" by F. D. Yeaple, published in the Oct. 12, 1970 addition of Product Engineering Magazine.

"Miniature Single-Stage Cryogenerator Reaches 30 Deg K" by Bernard Kovit, published in the Jan. 1961 issue of Space/Aeronautics Magazine.

"Applications of Closed-Cycle Cryocoolers to Small Superconducting Devices", edited by Zimmerman and Flynn, issued by the U.S. Department of Commerce, Apr. 1978, pp. 59–65.

"New Prime Mover" by J. F. J. Malone, published in the Journal of the Roay Society of Arts, Jun. 12, 1931, pp. 180–709.

*Primary Examiner*—Ronald C. Capossela

*Attorney, Agent, or Firm*—Brown & Martin

[57] ABSTRACT

A Malone-type final stage for utilization in a Stirling cycle cryogenic cooler apparatus includes a displacer slidable within a vessel. $^4$He, $^3$He, or a mixture thereof is made to flow in a pulsating unidirectional manner through a regenerator in the displacer by utilization of check valves in separate fluid channels. Stacked copper screen members extend through the channels and through a second static thermodynamic medium within the displacer to provide efficient lateral heat exchange and enable cooling to temperatures in the range of 3–4 K. Another embodiment utilizes sintered copper particles in the regenerator. Also described is a final stage that has a non-thermally conducting displacer having passages with check valves for directing fluid past a regenerator formed in the surrounding vessel.

8 Claims, 10 Drawing Figures

CRYOGENIC COOLER APPARATUS

ACKNOWLEDGMENT

The present invention was developed pursuant to Contract No. DOE DE-AS03-76-SF00034, PA DE-AT03-76 ER 70143 between the Department of Energy of the U.S. Government and the University of California.

BACKGROUND OF THE INVENTION

The present invention relates to refrigerator apparatus, and more particularly to a cryogenic cooler apparatus in which regeneration and contact between sources of hot and cold are improved to facilitate cooling to temperatures in the range of 3°-4° K.

The proliferation of products utilizing infrared detectors and similar heat-sensitive instruments has dramatically increased the need for cryogenic cooler apparatus. Furthermore, superconducting circuitry and hi-field strength superconducting magnets also require cryogenic cooler apparatus.

Many refrigeration systems utilizing Stirling cycle apparatus and Vuilleumier cycle apparatus have heretofore been developed for cryogenic cooling. In general, these cycles may be described as comprising the steps of supplying fluid such as helium under high pressure, initially cooling the fluid by passing it through regenerators while maintaining the high pressure, and then finally further cooling the initially cooled fluid through expansion and discharge. Typically, such apparatus incorporate pistons or displacers which are reciprocated in cylinders to force the fluid back and forth through regenerators in the appropriate phase relationship to produce cooling. Many of these apparatus have utilized multiple stages.

In cryogenic applications such as those described above, it is generally desirable to cool a medium to a temperature very close to absolute zero. For example, this will maximize sensitivity in a detector or minimize electrical resistance in a conductor. Prior cryogenic cooler apparatus of the Stirling cycle type or of the Vuilleumier cycle type are generally capable of cooling to temperatures in the range of 10°-15° K. In order to produce temperatures in the range of 4°-10° K., it is common to pre-cool helium in a mechanical refrigerator of the aforementioned type. The helium is then passed through a counter-current heat exchanger and finally through a Joule-Thomson expansion valve. The evolving cold gases or vapors pass back up through the heat exchanger, respectively pre-cooling the higher pressure gas before it is throttled. The aforementioned system which utilizes heat exchangers and unidirectional flow is complex, expensive, and susceptible to failures such as plugging due to freezing impurities.

Representative of the U.S. patents relating to cryogenic cooler apparatus are U.S. Pat. Nos. 3,218,815; 3,321,926; 3,372,554; 3,530,681; 3,678,992; 3,717,004; 3,765,187; 3,794,110; 3,991,586; 4,019,336; 4,044,567; 4,078,389; and 4,090,859. The aforementioned U.S. Pat. No. 3,218,815 discloses various cryogenic color apparatus including multiple displacers with internal regenerators. The heat exchange flow path extends through the regenerators and through narrow annular passages between the displacers and the cylinder walls. The aforementioned U.S. Pat. No. 3,794,110 discloses the utilization of $^3$He and $^4$He or a mixture of the same in heat exchangers in dilution refrigeration systems designed for cooling to temperatures below 10° K.

Also of general interest in this field are the following articles: "The Stirling Refrigeration Cycle" by J. W. L. Kohler published in Scientific American magazine, "Miniature single-stage cryogenerator reaches 30 deg K." by Bernard Kovit published in the January, 1961 issue of Space/Aeronautics magazine, and "Timed surge chamber creates self-acting cryogenic cooler" published in the Oct. 12, 1970 issue of Produce Engineering magazine.

SUMMARY OF THE INVENTION

It is the primary object of the present invention to provide a cryogenic cooler apparatus of the reciprocating displacer type in which regeneration and contact between sources of hot and cold are improved to enable the apparatus to produce temperatures in the range of 3°-4° K.

It is another object of the present invention to provide a final stage for a cryogenic cooler apparatus which utilizes pulsating uni-directional flow to enable temperatures very close to absolute zero to be produced reliably and without complex fluid circuitry and components.

The present invention provides an apparatus which may be utilized as the final stage in a conventional Stirling cycle cryocooler. In one embodiment, the apparatus is analogous to the regeneration of a liquid Malone engine. A reciprocating displacer is slidable within a vessel and is sealed thereto by rings. A central sealed chamber extends longitudinally within the displacer. A pair of channels also extend longitudinally through the displacer. The sealed chamber is filled with a second thermodynamic medium such as helium. Vertically stacked, copper screen members extend through each of the channels and through the sealed chamber to provide lateral thermal conductance with minimum longitudinal thermal conductance. A pair of check valves are mounted in the displacer so that a primary thermodynamic medium, for example helium, can only flow through the channels in opposite directions. During one-half cycle of operation, helium flows through one of the channels and is cooled. In the other half of the cycle, helium flows through the other channel and is heated. Regeneration and contact between sources of hot and cold are improved to enable temperatures in the range of 3°-4° K. to be produced.

In another embodiment, two channels through the displacer are each provided with oppositely oriented check valves, and each of the channels is substantially occupied by spaced apart packets or sections of sintered copper particles. In still another embodiment, a regenerator having a high transverse thermal conductance is formed in the wall of the vessel and the displacer is made of a material having a low thermal conductance. $^4$He, $^3$He, or a mixture thereof may be utilized as the first and second thermodynamic mediums in the various embodiments, depending upon the final temperature desired.

BRIEF DESCRIPTION OF THE DRAWINGS

Throughout the figures, like reference numerals refer to like parts unless otherwise indicated.

DESCRIPTION OF THE PREFERRED EMBODIMENTS

Figure 1:
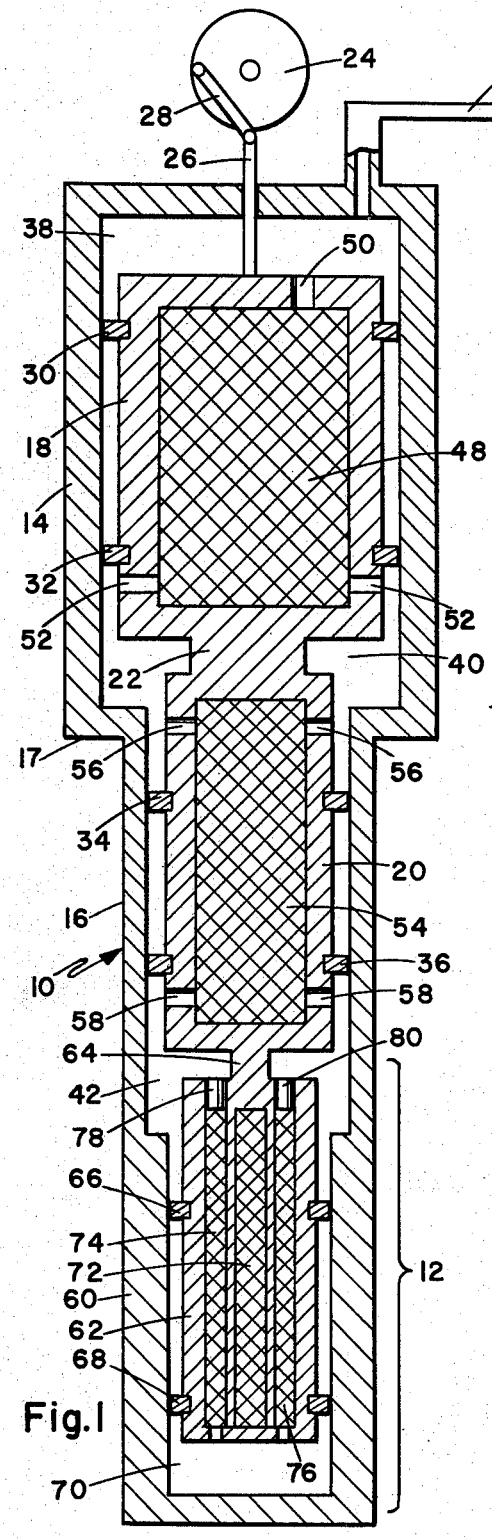
FIG. 1 is a simplified view of a cryogenic cooler apparatus incorporating as a final stage a first embodiment of the present invention. Portions of the apparatus are shown in a simplified vertical cross sectional view while other portions are shown schematically.

Referring to FIG. 1, there is illustrated therein a multi-stage cryogenic cooler apparatus 10 incorporating as a final stage 12 a first embodiment of the present invention. The apparatus 10 combines both the Stirling and Malone cycle modes of operation to produce cryogenic temperatures in the range of 3°-4° K.

Except for the final stage 12, the cryogenic cooler apparatus 10 has a construction which is well known in the art. It includes an upper large cylindrical vessel 14 and an intermediate smaller cylindrical vessel 16 sealed together in end to end fashion by a wall 17. An upper large cylindrical displacer 18 and an intermediate smaller cylindrical displacer 20 are rigidly connected in end to end fashion by a member 22. The displacers 18 and 20 are reciprocated within the vessels 14 and 16, respectively, by suitable drive means which may comprise a motor driven fly wheel 24, a piston rod 26 and a crank arm 28 for pivotally connecting the fly wheel and piston rod. Alternatively, the drive means for reciprocating the displacers 18 and 20 may be pneumatic.

A pair of vertically spaced rings 30 and 32 are seated in annular grooves which extend around the upper displacer 18 and slide against the inner wall of the vessel 14 to provide fluid tight seals. Similarly, a pair of vertically spaced rings 34 and 36 are seated in annular grooves which extend around the intermediate displacer 20. These rings slide against the inner wall of the intermediate vessel 16 to provide fluid tight seals. Within the vessels 14 and 16, the reciprocating displacers 18 and 20 define a warm expandable volume chamber 38 and first and second cold expandable volume chambers 40 and 42, respectively. A first thermodynamic medium or expansible working fluid is introduced into and discharged from the chamber 38 through a conduit 44. A fluid supply and discharge system 46 is connected to the chamber 38 through the conduit 44. Preferably the working fluid is $^4$He or $^3$He, or a mixture thereof, depending on what final temperature is desired. $^4$He has a critical temperature of 5.2° K. $^3$He has a critical temperature of 3.3° K. and enables a much lower temperature to be reached.

Within the upper displacer 18 (FIG. 1) is a large heat storage means in the form of a first regenerator 48. This regenerator may be constructed in any suitable form well known in the art. For example, it may comprise a large cylindrical chamber filled with copper screen, brass wool, or lead balls. The regenerator 48 is in fluid communication with the chamber 38 through a passage 50 and with the chamber 40 through passages 52. The passages 52 communicate with an annular groove (not visible in FIG. 1) formed in the outer curved wall of the upper displacer 18. Similarly, within the displacer 20 is located another heat storage means such as a second regenerator 54 which may be constructed in a fashion similar to that of the first regenerator 48. The second regenerator 54 is in fluid communication with the chamber 40 through passages 56 which communicate with an annular groove (not visible in FIG. 1) formed in the outer curved wall of the displacer 20. The second regenerator 54 is also in fluid communication with the chamber 42 at its lower end through passages 58 which also communicate with an annular groove formed in the outer curved wall of the displacer 20. It will thus be understood that reciprocation of the displacers 18 and 20 will cause the working fluid of the apparatus to reciprocate back and forth through the first and second regenerators 48 and 54. The fluid alternately gives up heat to these regenerators and receives heat therefrom.

The final stage 12 of the cryogenic cooler apparatus 10 (FIG. 1) includes a lower cylindrical vessel 60 whose upper end is integrally formed with the lower end of the intermediate vessel 16. The inner diameter of the lower vessel 60 is less than the inner diameter of the intermediate vessel 16. A lower cylindrical displacer 62 has its upper end rigidly connected to the lower end of the intermediate displacer 20 by a member 64. Thus, the drive means simultaneously reciprocates the displacers 18, 20 and 62 in the same phase. A pair of vertically spaced rings 66 and 68 are seated in annular grooves which extend around the lower displacer 62 and slide against the inner wall of the vessel 60 to provide fluid tight seals. Thus, a third cold expandable volume chamber 70 is defined between the lower end of the displacer 62 and the bottom of the vessel 60.

Figure 4:
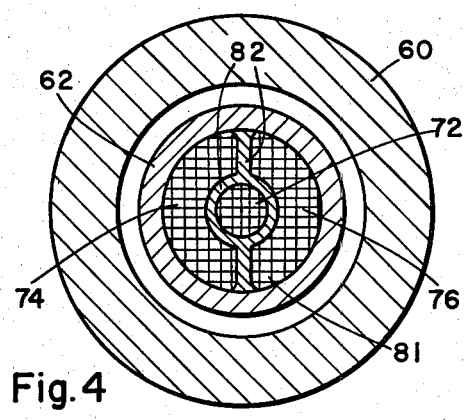
FIG. 4 is a horizontal sectional view taken along line 4—4 of FIG. 2.

Another heat storage means in the form of a third regenerator is located within the lower displacer 62. Specifically, a cylindrical chamber 72 (FIGS. 1, 2 and 4) extends axially down the center of the displacer 62 and is sealed at its opposite ends. A pair of left and right channels 74 and 76 extend axially through the lower displacer 62 in thermal contact with one another and with the center chamber 72 and provide fluid communication between the second and third cold expandable volume chambers, 42 and 70, respectively. The sealed chamber 72 is filled with a second thermodynamic medium through a tube not shown. This second thermodynamic medium is static, i.e., it does not circulate or reciprocate during the cycling of the apparatus, but remains stationary within the chamber 72. Preferably, the second thermodynamic medium is also $^4$he or $^3$He, or a mixture thereof.

Figure 2:
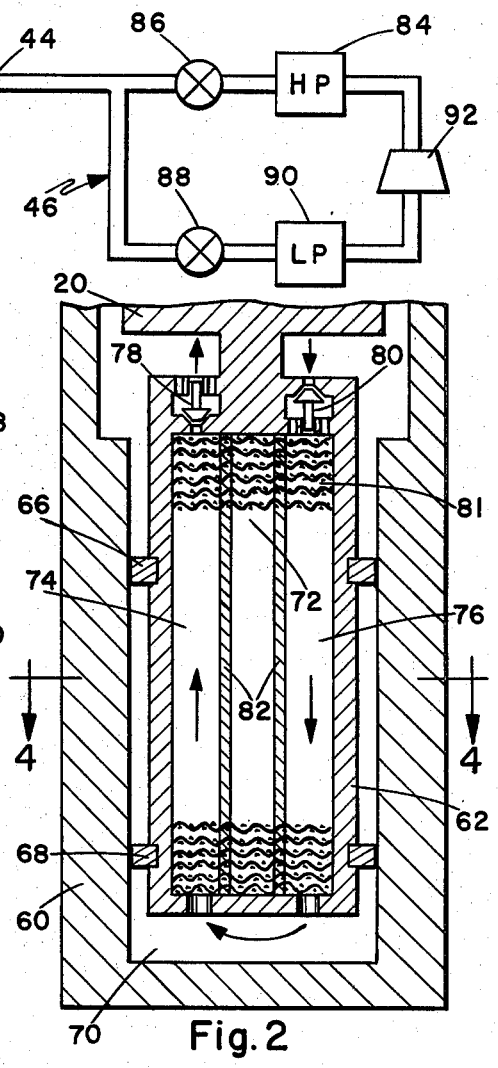
FIG. 2 is an enlarged view of the final stage of the apparatus of FIG. 1 showing its construction in greater detail.
Figure 3:
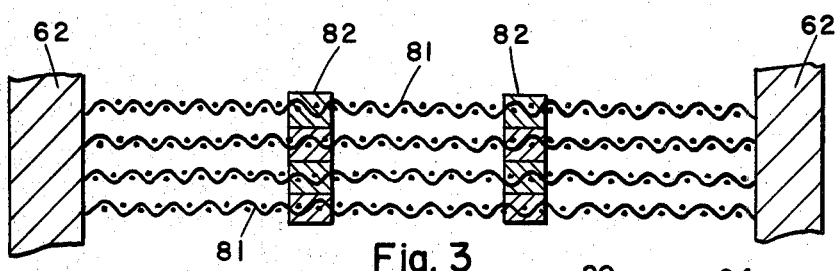
FIG. 3 is a greatly enlarged view of a portion of the structure of FIG. 2.

A pair of check valves 78 and 80 (FIGS. 1 and 2) are mounted at the upper ends of corresponding ones of the channels 74 and 76 so that fluid can only flow through the channels in a uni-directional manner as indicated by the arrows in FIG. 2. Preferably, the regenerator within the lower displacer 62 is constructed as hereafter described to maximize lateral thermal conductivity (left and right in FIG. 1) while minimizing longitudinal thermal conductivity (up and down in FIG. 1). This may be accomplished by utilizing a vertical stack of fine screen members 81 (FIGS. 2 and 3) made of a material such as copper and by providing seals 82 (FIGS. 3 and 4) formed of a material such as solder or epoxy resin to separate fluid in the channels 74 and 76 from each other and from fluid within the chamber 72. This arrangement permits effective lateral heat transfer between the fluids.

As the displacers 18, 20 and 62 (FIG. 1) reciprocate back and forth, fluid flows downwardly through the channel 76 (FIG. 2), through the third cold expandable volume chamber 70 and then back up through the channel 74 as indicated by the arrows in FIG. 2. The fluid thus flows through the third regenerator and through the chamber 70 in a pulsating, uni-directional manner. By contrast, fluid reciprocates back and forth through the first and second regenerators 48 and 54. More effective heat transfer within the regenerator in the lower displacer 62 and improved contact between the cold source in the chamber 70 and the article which is to be refrigerated results. The improved thermal contact is a consequence of the circulational flow of the cooled fluid in chamber 70.

The final stage 12 is designed so that heat flow into the third cold chamber 70 is minimized in order to permit the apparatus to produce temperatures therein in the range of 3°–4° K. The resulting heat flow into the cold end (the lowermost portion of the vessel 60) is proportional to the heat added due to regeneration inefficiency. Therefore, the lateral thermal contact between either channels 74 or 76 with one another and with the second medium in chamber 72 must be very good.

The regenerator located within the lower displacer 62 is also constructed to provide minimum longitudinal thermal conductance. It should be noted that the sizing of the expandable volume chambers 38, 40 and 42 above the Malone-type final stage 12 as well as the heat transfer efficiency of the first and second regenerators 48 and 54 must be such as to provide adequate pre-cooling of the working fluid (primary thermodynamic medium) prior to its entering the third regenerator.

It will be understood that for the sake of simplicity the material which thermally insulates the cryogenic cooler apparatus 10 (FIG. 1) from the 300° K. ambient environment is not shown in FIGS. 1–4. Likewise, not shown is the structure at the lower end of the lower vessel 60 for transferring the super cold generated in the chamber 70 to the end use article which is to be refrigerated.

Having broadly described the construction of the cryogenic cooler apparatus 10 (FIG. 1), its overall operation can now be explained. Working fluid is supplied to the chamber 38 from a high pressure reservoir 84 through a valve 86 and the conduit 44 during that portion of the cycle when the displacers 18, 20 and 62 are moving upward. Another valve 88 which connects a low pressure reservoir 90 to the conduit 44 is closed at this time. The respective high and low pressures of the reservoirs 84 and 90 are maintained by a compressor 92. As the three displacers are driven upwardly, working fluid flows downwardly through the first and second regenerators 48 and 54 and downwardly through the right channel 76 of the regenerator in the lower displacer 62. The fluid which so flows through each of the regenerators is cooled. In particular, the downwardly moving fluid in the right channel 76 will be precooled by both the second medium and the now static primary medium in the channel 74.

When the displacers 18, 20 and 62 have been driven to their uppermost positions in FIG. 1, the valve 86 is closed and the valve 88 is opened to permit the expansion and further cooling of the working fluid and its discharge into the low pressure reservoir 90. During the time that the valve 88 is open, the displacers 18, 20 and 62 are driven downwardly. Working fluid flows upwardly through the left channel 74 of the third regenerator, and upwardly through the second and first regenerators 54 and 48. As the working flows upwardly through the regenerators, it absorbs heat and cools the regenerators. In particular, the upwardly moving fluid in the left channel 74 will be warmed by both the second medium and the now static primary medium in the channel 76. This thermal effect is recovered by subsequent passage of the fluid through the regenerators. When the displacers reach their lowermost positions, the cycle is then ready to repeat. A wide variety of well known control systems can be utilized to open and close the valves 86 and 88 in the appropriate phase relationship to the movement of the displacers.

The cryogenic cooler apparatus 10 operates in a Malone cycle mode in its lower stage 12 where there is uni-directional flow in opposite directions through the channels 74 and 76. Heat is transferred laterally between each of the channels 74 and 76 and the second thermodynamic medium within the chamber 72. The remainder of the cryogenic cooler apparatus 10 operates in the Stirling cycle mode in that fluid reciprocates back and forth through regenerators as pressure is varied in the appropriate phase relationship to produce cooling.

Figure 5:
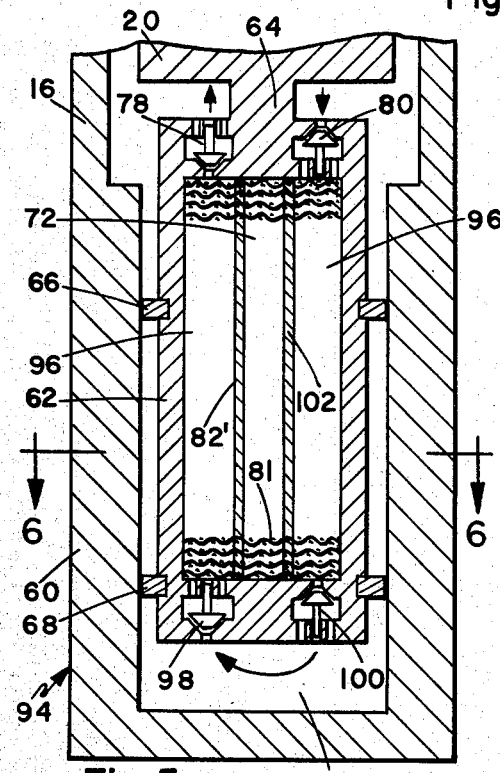
FIG. 5 is an enlarged vertical sectional view of a second embodiment of the present invention which may be utilized as the final stage of the apparatus of FIG. 1.
Figure 6:
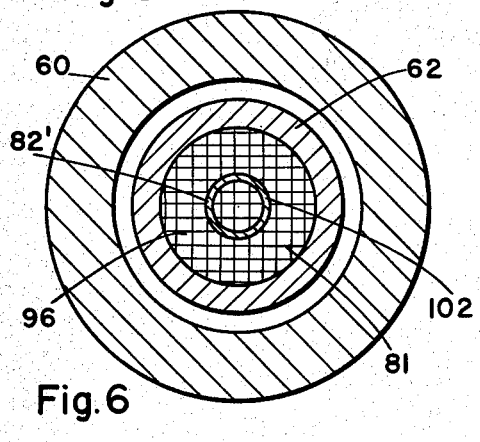
FIG. 6 is a horizontal sectional view taken along line 6—6 of FIG. 5.

FIGS. 5 and 6 illustrate a second embodiment 94 of the present invention which may be utilized as the final stage of a cryogenic cooler apparatus such as that illustrated in FIG. 1. The second embodiment 94 is constructed in a similar fashion to the final stage 12 (FIGS. 1–4) except that the regenerator of the former has an annular chamber 96 (FIGS. 5 and 6) which concentrically surrounds the sealed central chamber 72. This annular chamber 96 replaces the left and right channels 74 and 76 of the first embodiment of the present invention (FIG. 1). The check valves 80 and 78 (FIG. 5) at the upper end of the displacer 62 of the second embodiment permit working fluid to enter into, and exit from, respectively, the upper end of the third regenerator. In addition, a second pair of check valves 98 and 100 permit working fluid to enter into, and exit from, respectively, the lower end of the regenerator. Except for fluid flow through the check valves 78, 80, 98 and 100, the annular chamber 96 is otherwise sealed.

The central sealed chamber 72 (FIG. 5) is filled with a static second thermodynamic medium such as $^4He$, $^3He$, or a mixture of $^4He$ and $^3He$. Means are provided for exchanging heat between the warmer incoming working fluid and the colder outgoing working fluid through the second thermodynamic medium. In the second embodiment 94, a plurality of vertically stacked fine screen members 81 made of copper extend through the chambers 72 and 96. Annular seals 82' (FIG. 6) extend on either side of each of the screen members 81. These seals together form a cylindrical wall 102 (FIG. 5) which separates the second thermodynamic medium inside the central chamber 72 from the first thermodynamic medium inside the annular chamber 96.

The second embodiment illustrated in FIGS. 5 and 6 operates according to a hybrid Stirling/Malone cycle. Its regenerative efficiency permits temperatures in the range of 3°–4° K. to be produced in the cold chamber 70 when the appropriate fluids and dimensions are selected.

Figure 7:
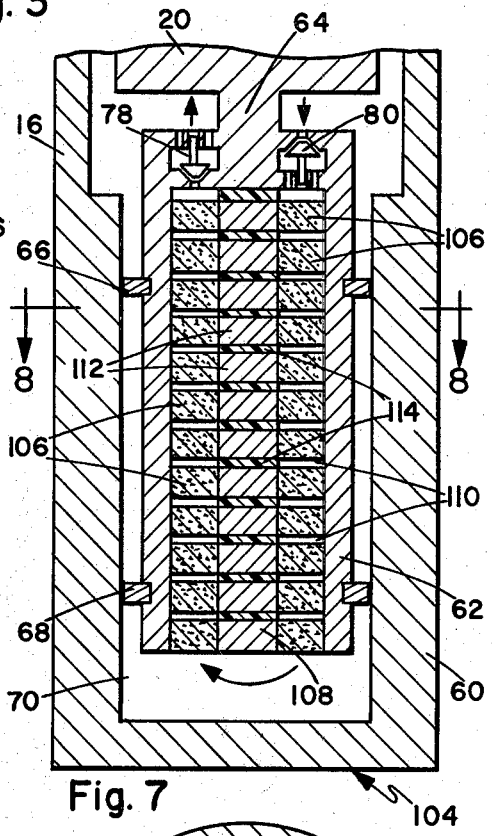
FIG. 7 is an enlarged vertical sectional view of a third embodiment of the present invention which may be utilized as the final stage of the apparatus of FIG. 1.
Figure 8:
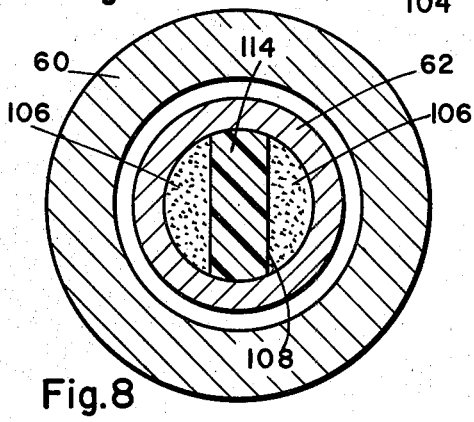
FIG. 8 is a horizontal sectional view taken along line 8—8 of FIG. 7.

FIGS. 7 and 8 illustrate a third embodiment 104 of the present invention which also may be utilized as the final stage of a cryogenic cooler apparatus such as that illustrated in FIG. 1. The construction of the third embodiment 104 is similar to that of the final stage 12 (FIGS. 1–4) except that the regenerator of the third embodiment 104 has a slightly different construction. The regenerator of the third embodiment 104 utilizes sintered copper powder. The sintered copper is formed into semicircular sections 106. As shown in FIGS. 7 and 8, two vertical stacks of the sintered copper sections 106 are positioned within a large cylindrical chamber in the displacer 62, on opposite sides of a solid second thermodynamic medium 108. Adjacent sections 106 in each of the stacks are separated by spaces 110 (FIG. 7). The solid second thermodynamic medium 108 is comprised of solid blocks 112 of a suitable composite material of high thermal conductivity and high heat capacity consisting, for example, of a sintered mixture of copper and an alloy having an appropriate magnetic ordering transition between 3°–10° K. These blocks are spaced apart by thermal insulators 114 made of a suitable material such as plastic. The vertical dimension of the blocks 112 is preferably the same as that of the sections 106. Each of the sections 106 is attached to one side of one of the blocks 114. The thermal insulators 114 thus define the spaces 110 between adjacent sections 106 in the same stack. As the displacer 62 reciprocates back and forth within the vessel 60, the primary thermodynamic medium in the form of helium working fluid flows downwardly through the stack of sintered copper sections 106 on the right side of the displacer in FIG. 7, into the cold chamber 70. The fluid then flows upwardly through the stack of sintered copper sections 106 on the left side of the displacer in FIG. 7. The flow of fluid through the regenerator of the third embodiment 104 thus occurs in a pulsating, uni-directional manner.

The plastic insulators 114 are preferably relatively thin and insure adequately small longitudinal thermal conductance. The effective sphere radius $r_s$ of the sintered copper powder is selected to allow the necessary heat exchange to permit temperature in the range of 3°–4° K. to be generated in the chamber 70. For the temperature range between 4°–10° K., theoretical calculations have indicated that a preferred value for $r_2$ might be in the range of 25–300 microns. Further calculations have indicated that it would be preferable to have at least thirty to forty sintered copper sections in each of the vertical stacks. In addition, it would be preferable for the sintered copper sections to be spaced apart at least 100 microns in order to give adequate isolation. The check valves should each be enclosed in non-thermally conducting housings.

Figure 9:
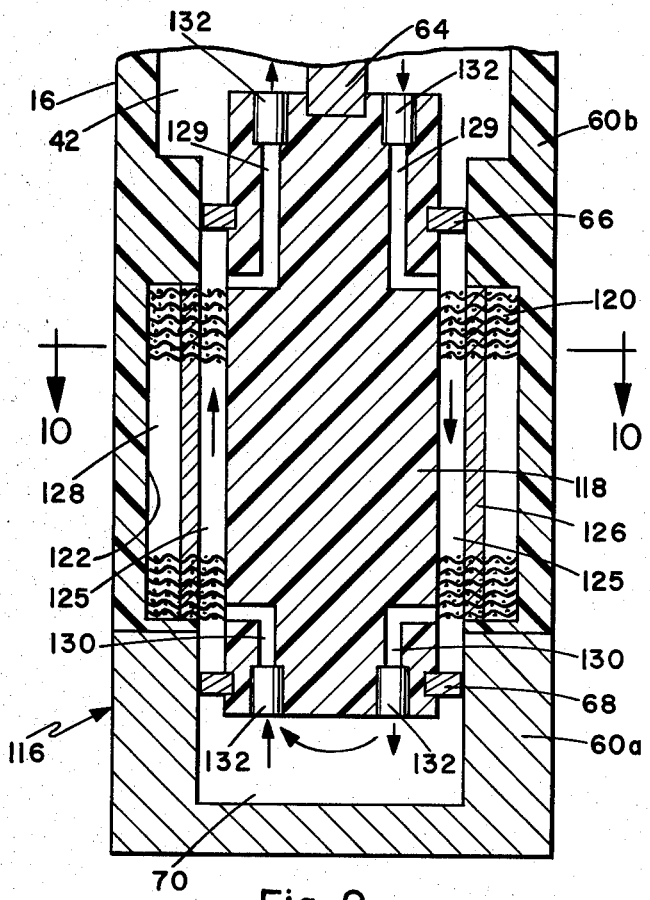
FIG. 9 is an enlarged vertical sectional view of a fourth embodiment of the present invention which may be utilized as the final stage of the apparatus of FIG. 1.
Figure 10:
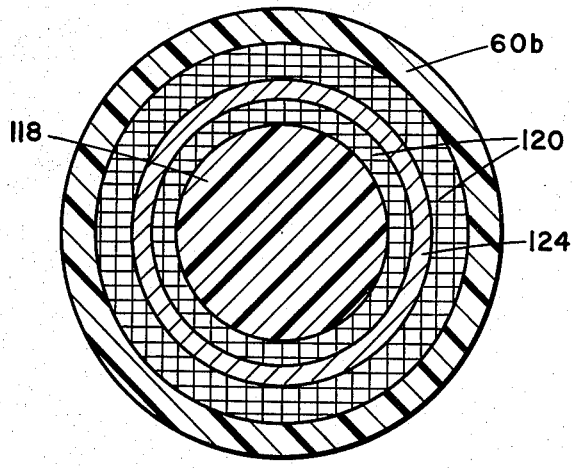
FIG. 10 is a horizontal sectional view taken along line 10—10 of FIG. 9.

FIGS. 9 and 10 illustrate a fourth embodiment 116 of the present invention which may be utilized as the final stage in a cryogenic cooler apparatus such as that illustrated in FIG. 1. The fourth embodiment includes a solid displacer 118 movable within the vessel 60. The lower portion **60*a* of the vessel is made of a highly thermally conductive material such as copper to facilitate thermal contact with the article to be refrigerated. The upper portion 60*b* is made of a thermally poorly conducting material such as fiberglass to reduce longitudinal heat leak. The displacer 118 is made of a non-thermally conducting material such as plastic. The regenerator in this embodiment has a high transverse thermal conductance and a low longitudinal thermal conductance to improve heat regeneration and reduce longitudinal conduction losses and thereby enable very low temperatures within the chamber 70 to be generated. The regenerator is formed in the walls of the vessel 60, externally of the displacer 118. A plurality of ring shaped fine copper screen members 120 are vertically stacked in an annular recess 122 formed in the inner wall of the vessel 60. A plurality of ring-shaped seals 124 (FIG. 10) affixed to each of the screen members 120 together form a cylindrical wall 126 (FIG. 9). This wall defines an annular chamber 128** which is filled with a static second thermodynamic medium.

Each of the screen rings 120 (FIG. 9) extends into the annular space 125 between the cylindrical wall 126 and the outer curved surface of the displacer 118. A pair of passages 129 formed in the upper end of the displacer 118 provide fluid communication between the expandable volume chamber 42 and the annular space 125. Similarly, a pair of passages 130 formed in the lower end of the displacer 118 provide fluid communication between the expandable volume chamber 70 and the annular space 125.

Four check valves 132 are positioned at the ends of corresponding ones of the passages 128 and 130 and are oriented to provide uni-directional flow as indicated by the arrows in FIG. 9. As the displacer 118 reciprocates back and forth, working fluid is alternately cooled and heated by the regenerator formed in the inner wall of the vessel 60.

Experiments have indicated that the effective lateral screen conductivity in regenerators of the type illustrated in FIGS. 2, 5 and 9 is approximately one quarter the thermal conductivity of bulk copper. The effective thermal conductivity in the longitudinal direction in these regenerators can be made much less than a tenth of that of bulk copper. The screen members utilized in the various embodiments described above may be formed of woven copper threads of the 4.3 mil diameter with a 10 mil pitch.

The various embodiments of the present invention may be utilized as the final stage of a multi-stage cryogenic cooler apparatus such as that illustrated in FIG. 1. However, it should be understood that the present invention may be utilized as the final stage in a wide variety of other cryogenic cooler apparatus. For example, in a compact and simple configuration the intermediate stage in the apparatus of FIG. 1 could be eliminated. Additionally, the final stage disclosed herein may be precooled by another refrigerator having its own working fluid. Therefore, the protection afforded our invention should be limited only in accordance with the scope of the following claims:

We claim:

1. Cryogenic cooler apparatus comprising:

a vessel;

a displacer slidable within the vessel to define a warm expandable volume chamber and a cold expandable volume chamber;

means for reciprocating the displacer in the vessel;

means for supplying a working fluid selected from the group consisting of $^4$He, $^3$He, and a mixture of $^4$He and $^3$He to the warm expandable volume chamber of the vessel under high pressure and for having the working fluid discharged therefrom under low pressure; and a regenerator having one end in fluid communication with the warm expandable volume chamber and its other end in fluid communication with the cold expandable volume chamber, including check valve means for controlling the flow of the working fluid through the regenerator and the cold expandable volume chamber.

2. An apparatus according to claim 1 wherein the regenerator is located within the displacer.

3. An apparatus according to claim 1 wherein the regenerator includes:

a central sealed chamber extending longitudinally within the displacer;

a pair of channels extending longitudinally through the displacer parallel to the sealed chamber;

a pair of check valves mounted within the displacer for causing the working fluid to flow through the channels in opposite directions;

a second thermodynamic medium within the sealed chamber; and means for transferring heat from the working fluid in one of the channels, to both the second thermodynamic medium and the working fluid within the other one of the channels with a minimum amount of longitudinal thermal conductance.

4. An apparatus according to claim 3 wherein:

the second thermodynamic medium is selected from the group consisting of $^4He$, $^3He$ and a mixture of $^4He$ and $^3He$;

and the transferring means includes a plurality of stacked screen members each extending through the channels and the sealed chamber.

5. An apparatus according to claim 1 wherein the regenerator includes:

a central sealed chamber extending longitudinally within the displacer;

a second chamber extending longitudinally within the displacer, surrounding the sealed chamber and communicating with a first pair of passages extending through one end of the displacer and a second pair of passages extending through the other end of the second displacer;

a check valve in each of the passages, the pair of check valves at each end of the displacer being oppositely oriented;

a second thermodynamic medium within the sealed chamber; and means for transferring heat from the working fluid in the second chamber to the second thermodynamic medium in the sealed chamber with a minimum amount of longitudinal thermal conductance.

6. An apparatus according to claim 5 wherein:

the second thermodynamic medium is a fluid selected from the group consisting of $^4He$, $^3He$ and a mixture of $^4He$ and $^3He$; and the transferring means includes a plurality of stacked screen members each extending through the second chamber and the sealed chamber within the displacer.

7. An apparatus according to claim 1 wherein the regenerator includes:

a chamber extending longitudinally within the displacer and communicating with a first pair of passages extending through one end of the displacer and a second pair of passages extending through the other end of the displacer;

a second thermodynamic medium dividing the chamber in the displacer into two longitudinally extending portions each communicating with one of the passages at each end thereof, the second thermodynamic medium having a high lateral thermal conductance, a high heat capacity, and a minimum longitudinal thermal conductance;

a plurality of longitudinally spaced sections made of sintered copper powder substantially filling each of the chamber portions in the displacer; and a pair of check valves mounted within the displacer for causing the working fluid to flow through the chamber portions in opposite directions.

8. An apparatus according to claim 1 wherein:

the displacer is made of a material having low thermal conductivity, and has a first pair of passages extending through its one end and communicating with a space between the displacer and the vessel, and a second pair of passages extending through the other end of the displacer and communicating with the space between the displacer and the vessel; and the regenerator includes a chamber formed in the vessel and surrounding the displacer, a second thermodynamic medium within the chamber formed in the vessel, means for transferring heat between the working fluid and the second thermodynamic medium, and a check valve in each of the passages in the displacer, the pair check valves at each end of the displacer being oppositely oriented.

* * * * *